US008098871B2

(12) United States Patent
Akino

(10) Patent No.: US 8,098,871 B2
(45) Date of Patent: Jan. 17, 2012

(54) DYNAMIC MICROPHONE

(75) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 525 days.

(21) Appl. No.: 12/382,579

(22) Filed: Mar. 19, 2009

(65) Prior Publication Data

US 2009/0238392 A1 Sep. 24, 2009

(30) Foreign Application Priority Data

Mar. 24, 2008 (JP) ..... 2008-075319

(51) Int. Cl.
*H04R 25/00* (2006.01)

(52) U.S. Cl. ..... 381/360; 381/355; 381/177

(58) Field of Classification Search ..... 381/355, 381/356, 357, 358, 360, 361, 362, 170, 173, 381/177
See application file for complete search history.

(56) References Cited

U.S. PATENT DOCUMENTS 6,091,828 A * 7/2000 Akino et al. ..... 381/355
8,031,898 B2 * 10/2011 Akino ..... 381/355
2007/0269059 A1 * 11/2007 Akino et al. ..... 381/170

* cited by examiner

*Primary Examiner* — Huyen D Le
(74) *Attorney, Agent, or Firm* — Manabu Kanesaka

(57) ABSTRACT

Even in the case where the volume of a back air chamber is small, sounds with a low frequency (low range) can be captured by equivalently decreasing the acoustic impedance of the back air chamber. A dynamic microphone includes a microphone unit 20 that includes a diaphragm 21 having a voice coil 21*a* and a magnetic circuit 22 having a magnetic gap; and a microphone case 10 that supports the microphone unit 20 on one end side thereof and has the back air chamber 12*a* provided on the back surface side of the diaphragm 21 via an acoustic resistance material 26 therein. In this dynamic microphone, an additional microphone unit 40 is provided besides the microphone unit 20; a membrane plate 50 consisting of a piezoelectric element, which deforms curvedly toward the back air chamber 12*a* side according to an applied voltage, is provided between the acoustic resistance material 26 and the back air chamber 12*a*; and the membrane plate 50 is driven by the sound signal (voltage signal) delivered from the additional microphone unit 40. Thereby, the acoustic impedance of the back air chamber 12*a* is decreased equivalently.

5 Claims, 3 Drawing Sheets

DYNAMIC MICROPHONE

CROSS-REFERENCE TO RELATED APPLICATIONS

The present application is based on, and claims priority from, Japanese Application Serial Number JP2008-075319, filed Mar. 24, 2008, the disclosure of which is hereby incorporated by reference herein in its entirety.

TECHNICAL FIELD

The present invention relates to a dynamic microphone. More particularly, it relates to a technique in which the acoustic impedance of a back air chamber provided on the back side of a diaphragm is decreased equivalently when the pressure on the front side of the diaphragm increases, whereby sounds to a low range can be captured.

BACKGROUND ART

The general configuration of a dynamic microphone is explained with reference to FIG. 4. The dynamic microphone, which is mainly used for vocals and speech, includes a cylindrical microphone case 10 serving as a grip part. Usually, the microphone case 10 is made of a metal such as brass alloy.

In this example, in the microphone case 10, an internal cylinder 12 is held coaxially via a shock mount member 11 consisting of a rubber elastic body, and a microphone unit 20 is supported on one end side of the internal cylinder 12.

The microphone unit 20 includes a diaphragm 21 having a voice coil 21*a*, and a magnetic circuit 22. The diaphragm 21 has a center dome and a sub dome formed around the center dome. To the boundary part between the center dome and the sub dome, the voice coil 21*a* is attached with an adhesive.

The magnetic circuit 22 includes a disc-shaped magnet 22*a* magnetized in the thickness direction, a bottomed cylindrical yoke 22*b* arranged on one pole side of the magnet 22*a*, and a center pole piece 22*c* arranged on the other pole side of the magnet 22*a*, and a magnetic gap is formed between the yoke 22*b* and the center pole piece 22*c*.

The diaphragm 21 and the magnetic circuit 22 are assembled to one end side of a unit holder 23 in the state in which the voice coil 21*a* is arranged oscillatably in the magnetic gap. On the diaphragm 21, a resonator 24 having a front acoustic terminal 24*a* is put.

In the case of a unidirectional dynamic microphone, the unit holder 23 is provided with a rear acoustic terminal 23*a* communicating with the back surface of the diaphragm 21. Both of the front acoustic terminal 24*a* and the rear acoustic terminal 23*a* are holes for allowing sound waves to pass through.

To the other end side of the unit holder 23, a cap 25 having a sound hole 25*a* covered with an acoustic resistance material 26 is fitted. Thereby, in the internal cylinder 12, a back air chamber 12*a* communicating with the back surface side of the diaphragm 21 via the acoustic resistance material 26 is formed.

To one end side of the microphone case 10, a protective cover 27 consisting of a metallic mesh is attached to protect the microphone unit 20 from a drop shock or the like, and on the other end side of the microphone case 10, an output connector 30 is mounted.

The unidirectional dynamic microphone has both of a mass control property and a resistance control property. In contrast, a non-directional dynamic microphone has a resistance control property only. The driving force of a non-directional component is obtained by a difference in pressure between the front surface side (sound receiving surface side) of the diaphragm 21 and the back air chamber 12*a* existing on the back surface side thereof, and also is controlled by the acoustic resistance of the acoustic resistance material 26.

FIG. 5 shows an acoustic equivalent circuit of the unidirectional dynamic microphone. In FIG. 5, symbol P1 denotes a front sound source, P2 denotes a rear sound source, m0 and s0 denote the mass and stiffness of the diaphragm 21, respectively, r1 denotes the acoustic resistance of the acoustic resistance material 26, s1 denotes the stiffness of the back air chamber 12*a*, and m1 denotes the mass of the back air chamber 12*a*.

In the dynamic microphone, the size (volume) of the back air chamber 12*a* greatly affects the frequency band of sound capture. For example, if the back air chamber 12*a* is small, the impedance of the back air chamber 12*a* increases at a low frequency.

Therefore, considering the capture of sounds to a low range, the dynamic microphone, both unidirectional and non-directional, is designed so that the impedance of the back air chamber 12*a* is decreased by increasing the volume of the back air chamber 12*a*.

However, the increase in volume of the back air chamber 12*a* hinders the design of other parts. In particular, in a microphone in which an electronic circuit is mounted in the microphone case 10 serving as a grip part, such as a wireless microphone, the volume of the back air chamber 12*a* cannot be secured sufficiently.

Japanese Patent Application Publication No. S62-000197 describes a dynamic microphone in which the volume of the back air chamber can be changed according to the microphone type. In this dynamic microphone, however, the volume of the back air chamber is changed by a configuration in which a movable partition plate is provided in the back air chamber having a predetermined fixed volume, and the interior of the back air chamber is divided into two by the movable partition plate. Therefore, the volume of the back air chamber itself cannot be increased further.

Accordingly, an object of the present invention is to provide a dynamic microphone in which even in the case where the volume of a back air chamber is small, sounds with a low frequency (low range) can be captured by equivalently decreasing the acoustic impedance of the back air chamber.

SUMMARY OF THE INVENTION

To solve the above object, the present invention provides a dynamic microphone including a microphone unit which includes a diaphragm having a voice coil and a magnetic circuit having a magnetic gap in which the voice coil is oscillatably arranged; and a microphone case which supports the microphone unit on one end side thereof and has a back air chamber provided on the back surface side of the diaphragm via an acoustic resistance material therein, wherein an additional microphone unit is provided to deliver a sound signal upon receipt of sound waves arriving at the microphone unit; a membrane plate consisting of a piezoelectric element, which deforms curvedly toward the back air chamber side according to an applied voltage, is provided between the acoustic resistance material and the back air chamber; and the membrane plate is driven by the sound signal delivered from the additional microphone unit.

In the present invention, a non-directional microphone unit is preferably used as the additional microphone unit.

Among the non-directional microphone units, especially, an electret condenser microphone unit and a piezoelectric microphone unit that do not require a power source are more favorable. However, for a microphone incorporating a battery, such as a wireless microphone, or a microphone supplied with electric power through a wire, a condenser microphone unit may be used.

According to the present invention, the additional microphone unit is provided to deliver a sound signal upon receipt of sound waves arriving at the microphone unit; the membrane plate consisting of a piezoelectric element, which deforms curvedly toward the back air chamber side according to an applied voltage, is provided between the acoustic resistance material and the back air chamber; and the sound signal delivered from the additional microphone unit is applied to the membrane plate with the increase in pressure on the front surface side of the diaphragm. Therefore, the membrane plate operates so as to compress the back air chamber, and thereby the acoustic impedance of the back air chamber is decreased equivalently, so that even if the back air chamber is small, sounds with a low frequency (low range) can be captured.

DETAILED DESCRIPTION

Figure 1:
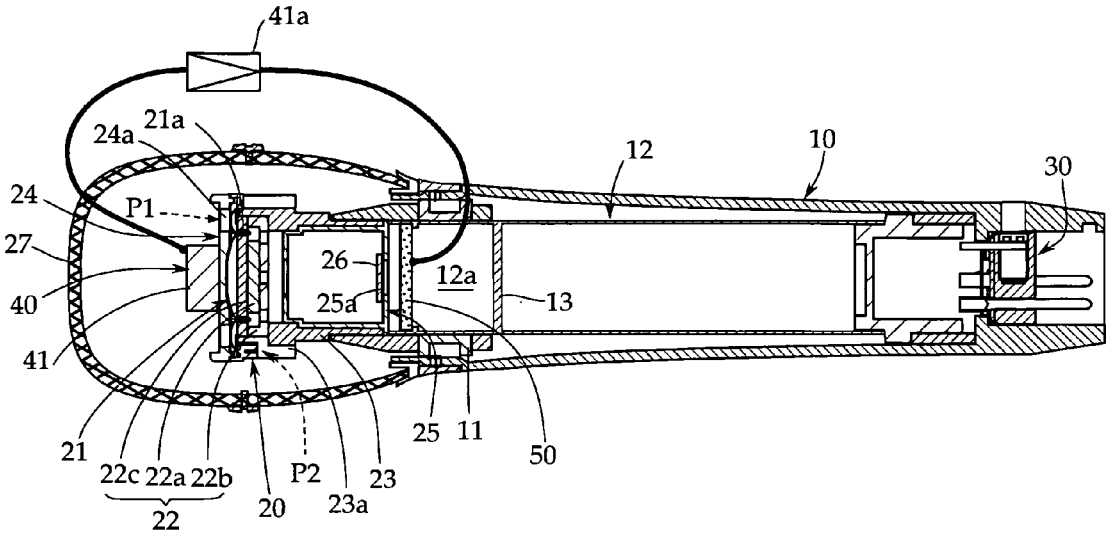
FIG. 1 is a sectional view of a dynamic microphone in accordance with a first embodiment of the present invention.
Figure 2:
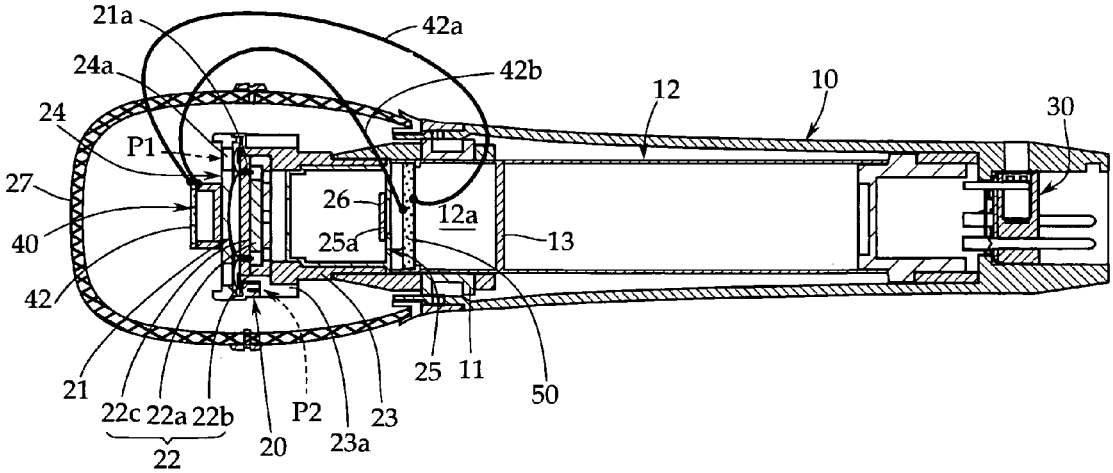
FIG. 2 is a sectional view of a dynamic microphone in accordance with a second embodiment of the present invention.
Figure 3:
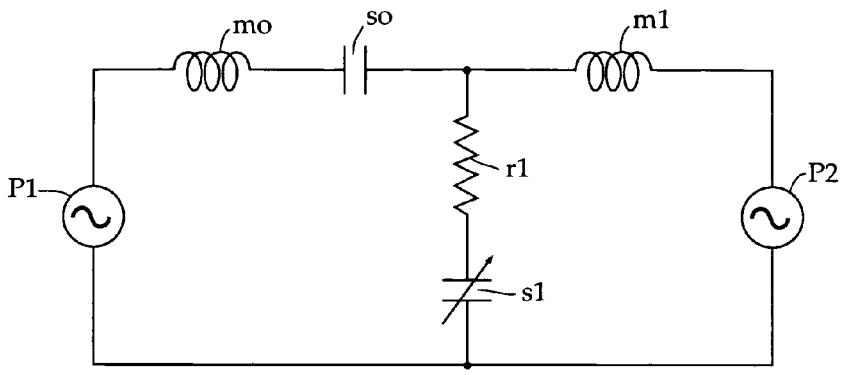
FIG. 3 is an acoustic equivalent circuit diagram for the dynamic microphones in accordance with the embodiments shown in FIGS. 1 and 2.
Figure 4:
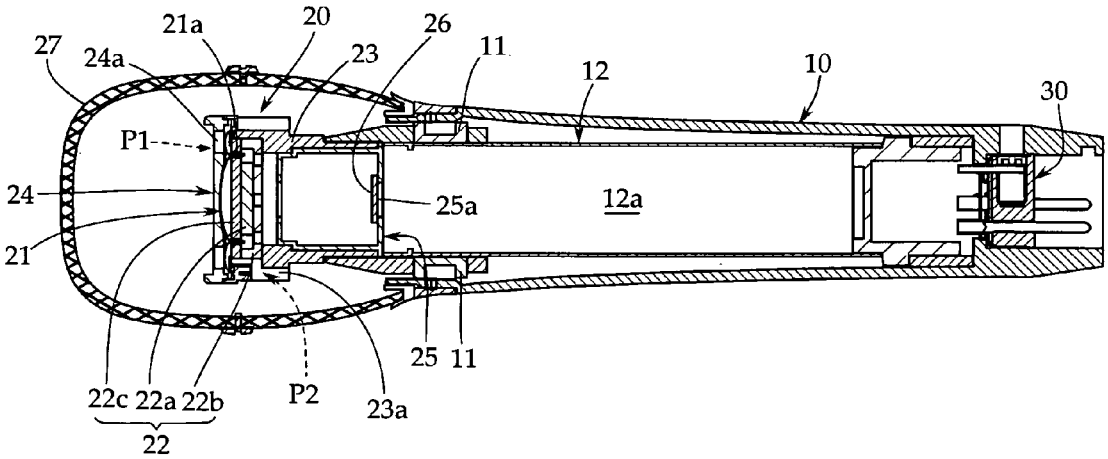
FIG. 4 RELATED ART
FIG. 4 is a sectional view showing the general configuration of a conventional dynamic microphone.
Figure 5:
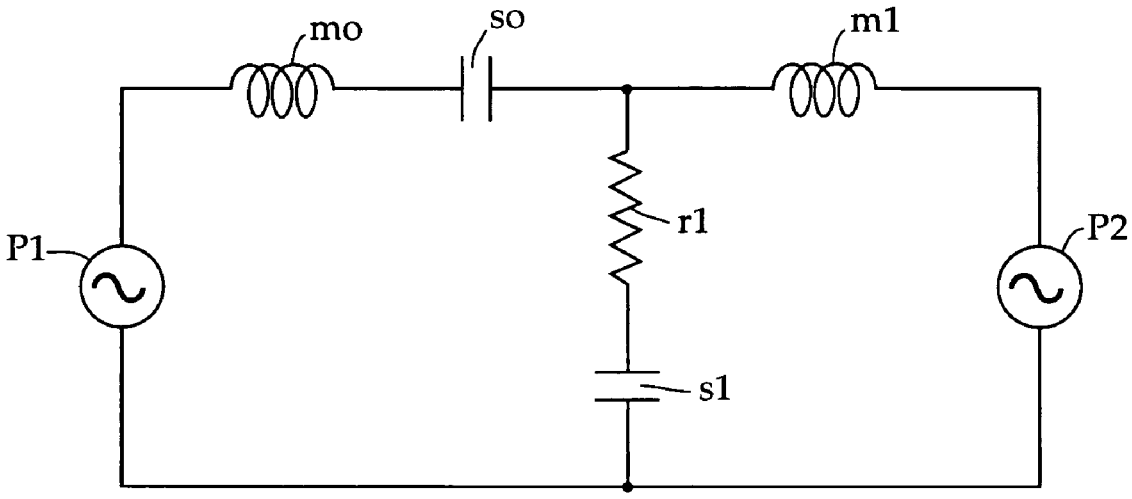
FIG. 5 RELATED ART
FIG. 5 is an acoustic equivalent circuit diagram for the conventional dynamic microphone shown in FIG. 4.

Embodiments of the present invention will now be described with reference to FIGS. 1 to 3. FIG. 1 is a sectional view of a dynamic microphone in accordance with a first embodiment of the present invention. FIG. 2 is a sectional view of a dynamic microphone in accordance with a second embodiment of the present invention. FIG. 3 is an acoustic equivalent circuit diagram for the dynamic microphones in accordance with the above-described embodiments. The same reference symbols are applied to elements that are the same as those of the conventional example explained before with reference to FIG. 4.

First, the first embodiment shown in FIG. 1 is explained. This dynamic microphone includes a cylindrical microphone case 10 made of a metal such as brass alloy, which is used as a grip part.

In this embodiment as well, in the microphone case 10, an internal cylinder 12 is held coaxially via a shock mount member 11 consisting of a rubber elastic body, and a microphone unit 20 is supported on one end side of the internal cylinder 12.

The microphone unit 20 includes a diaphragm 21 having a voice coil 21*a*, and a magnetic circuit 22. The diaphragm 21, which is made of a synthetic resin film, has a center dome and a sub dome formed around the center dome. To the boundary part between the center dome and the sub dome, the voice coil 21*a* is attached with an adhesive.

The magnetic circuit 22 includes a disc-shaped magnet 22*a* magnetized in the thickness direction, a bottomed cylindrical yoke 22*b* arranged on one pole side of the magnet 22*a*, and a center pole piece 22*c* arranged on the other pole side of the magnet 22*a*, and a magnetic gap is formed between the yoke 22*b* and the center pole piece 22*c*.

The diaphragm 21 and the magnetic circuit 22 are assembled to one end side of a unit holder 23 in the state in which the voice coil 21*a* is arranged oscillatably in the magnetic gap. On the diaphragm 21, a resonator 24 having a front acoustic terminal 24*a* is put.

The dynamic microphone in accordance with this embodiment is unidirectional, and the unit holder 23 is provided with a rear acoustic terminal 23*a* communicating with the back surface of the diaphragm 21. Both of the front acoustic terminal 24*a* and the rear acoustic terminal 23*a* are holes for allowing sound waves to pass through.

To the other end side of the unit holder 23, a cap 25 is fitted. The cap 25 is provided with a sound hole 25*a* covered with an acoustic resistance material 26. The microphone unit 20 is supported on the internal cylinder 12 by inserting the other end side of the unit holder 23 into the internal cylinder 12.

To one end side of the microphone case 10, a protective cover 27 consisting of a metallic mesh is attached to protect the microphone unit 20 from a drop shock or the like, and on the other end side of the microphone case 10, an output connector 30 is mounted.

In the present invention, besides the microphone unit 20, an additional microphone unit 40 is provided. The additional microphone unit 40 is preferably arranged on the resonator 24 to receive sound waves arriving at the microphone unit 20 from a sound source, not shown.

As the additional microphone unit 40, a non-directional microphone unit is preferably used. In this first embodiment, as the additional microphone unit 40, a non-directional electret condenser microphone unit 41 is used.

In the present invention as well, a back air chamber 12*a* is provided in the internal cylinder 12. In this embodiment, however, the interior of the internal cylinder 12 is partitioned by a partition plate 13 because the internal cylinder 12 contains electronic circuit parts, not shown, and the like, so that the volume of the back air chamber 12*a* is decreased significantly as compared with the conventional example.

By this configuration, at a low frequency, the acoustic impedance of the back air chamber 12*a* is increased, which hinders the sound capture in a low range. To solve this problem, in the present invention, a membrane plate 50 consisting of a piezoelectric element is provided between the acoustic resistance material 26 and the back air chamber 12*a*. The peripheral edge of the membrane plate 50 is fixed to the inner wall surface of the internal cylinder 12 with a fixing means such as an adhesive.

The piezoelectric element deforms according to an applied voltage. In the present invention, design is made so that the central part of the membrane plate 50 deforms curvedly toward the back air chamber 12*a* side when a voltage is applied.

In this first embodiment, a sound signal (voltage signal) delivered from the electret condenser microphone unit 41 used as the additional microphone unit 40 is applied to the membrane plate 50 by being amplified to a predetermined value by an amplifier 41*a*.

When the pressure on the front surface side (sound receiving surface side) of the diaphragm 21 is raised by the sound waves coming from the sound source, not shown, the level of the voltage signal delivered from the electret condenser microphone unit 41 becomes high. Accordingly, the central part of the membrane plate 50 is deformed curvedly toward the back air chamber 12*a* side, by which the back air chamber 12*a* is compressed. Thereby, the pressure on the back surface side of the diaphragm 21 is decreased relatively.

As a result, operation is performed so that the acoustic impedance of the back air chamber 12*a* decreases equivalently. Therefore, even in the case where the volume of the back air chamber 12*a* is small, sounds can be captured at a low frequency.

Next, the second embodiment shown in FIG. 2 is explained. The second embodiment differs from the above-described first embodiment in that a piezoelectric microphone unit 42 is used as the additional microphone unit 40. Other configurations are the same as those of the first embodiment, and therefore the explanation thereof is omitted.

For the piezoelectric microphone unit 42, an electromotive voltage is produced by the deformation of a diaphragm consisting of a piezoelectric element caused by sound waves. Therefore, the output terminal thereof can be connected directly to the membrane plate 50 via two lead wires 42*a* and 42*b*. In some cases, the output terminal may be connected to the membrane plate 50 via a voltage amplifier.

The operation is the same as that of the first embodiment. When the pressure on the front surface side (sound receiving surface side) of a diaphragm 21 is raised by the sound waves coming from the sound source, not shown, a voltage proportional to the pressure is delivered from the piezoelectric microphone unit 42.

Thereby, the central part of the membrane plate 50 is deformed curvedly toward the back air chamber 12*a* side, by which the back air chamber 12*a* is compressed. Accordingly, the pressure on the back surface side of the diaphragm 21 is decreased relatively. As a result, operation is performed so that the acoustic impedance of the back air chamber 12*a* decreases equivalently. Therefore, even in the case where the volume of the back air chamber 12*a* is small, sounds can be captured at a low frequency.

FIG. 3 shows an acoustic equivalent circuit of the dynamic microphone in accordance with the present invention having been explained in the first and second embodiments.

In FIG. 3, symbol P1 denotes a front sound source, P2 denotes a rear sound source, m0 and s0 denote the mass and stiffness of the diaphragm 21, respectively, r1 denotes the acoustic resistance of the acoustic resistance material 26, s1 denotes the stiffness of the back air chamber 12*a*, and m1 denotes the mass of the back air chamber 12*a*. In the present invention, since the acoustic impedance of the back air chamber 12*a* can be decreased equivalently, the stiffness s1 of the back air chamber 12*a* can be represented by a variable capacitor.

The additional microphone unit 40 in the first and second embodiments is favorable especially in that the driving power source therefor is not needed. On the other hand, for a microphone incorporating a battery, such as a wireless microphone, or a microphone supplied with electric power from a phantom power source, as the additional microphone unit 40, a condenser microphone unit requiring a polarization power source can also be used.

In the above-described embodiments, the back air chamber 12*a* is provided in the internal cylinder 12 arranged in the microphone case 10. In this case, since the internal cylinder 12 is included in the microphone case 10 as an element thereof, the back air chamber 12*a* may be made be provided substantially in the microphone case 10.

The invention claimed is:

1. A dynamic microphone comprising a microphone unit which includes a diaphragm having a voice coil and a magnetic circuit having a magnetic gap in which the voice coil is oscillatably arranged; and a microphone case which supports the microphone unit on one end side thereof and has a back air chamber provided on the back surface side of the diaphragm via an acoustic resistance material therein, wherein an additional microphone unit is provided to deliver a sound signal upon receipt of sound waves arriving at the microphone unit; a membrane plate consisting of a piezoelectric element, which deforms curvedly toward the back air chamber side according to an applied voltage, is provided between the acoustic resistance material and the back air chamber; and the membrane plate is driven by the sound signal delivered from the additional microphone unit.

2. The dynamic microphone according to claim 1, wherein a non-directional microphone unit is used as the additional microphone unit.

3. The dynamic microphone according to claim 2, wherein an electret condenser microphone unit is used as the non-directional microphone unit.

4. The dynamic microphone according to claim 2, wherein a condenser microphone unit is used as the non-directional microphone unit.

5. The dynamic microphone according to claim 2, wherein a piezoelectric microphone unit is used as the non-directional microphone unit.

* * * * *